United States Patent [19]

Kunz et al.

[11] Patent Number: 4,756,282

[45] Date of Patent: Jul. 12, 1988

[54] DIRECT ACTING HYDRAULIC VALVE LIFTER WITH INTEGRAL PLUNGER

[75] Inventors: Timothy W. Kunz, Rochester; Donald G. Cole, Honeoye Falls, both of N.Y.; Richard S. Knape, Grand Rapids; Arthur N. Krein, Birmingham, both of Mich.

[73] Assignee: General Motors Corporation, Detroit, Mich.

[21] Appl. No.: 90,920

[22] Filed: Aug. 31, 1987

[51] Int. Cl.[4] ..... F01L 1/24

[52] U.S. Cl. ..... 123/90.55

[58] Field of Search ..... 123/90.55, 90.52, 90.53, 123/90.57

[56] References Cited

U.S. PATENT DOCUMENTS

| | | | |
|---|---|---|---|
| 2,880,710 | 4/1959 | O'Neill | 123/90.55 |
| 3,509,858 | 5/1970 | Scheibe et al. | 123/90.55 |
| 4,465,038 | 8/1984 | Speil | 123/90.55 |
| 4,470,381 | 9/1984 | Buente et al. | 123/90.55 |
| 4,567,862 | 2/1986 | Kodama | 123/90.55 |
| 4,578,094 | 4/1986 | Doppling et al. | 123/90.55 |
| 4,590,898 | 5/1986 | Buente et al. | 123/90.55 |
| 4,610,225 | 9/1986 | Camosso et al. | 123/90.55 |

FOREIGN PATENT DOCUMENTS

| | | |
|---|---|---|
| 1808000 | 5/1970 | Fed. Rep. of Germany . |
| 2158156 | 5/1973 | Fed. Rep. of Germany . |
| 2758957 | 7/1979 | Fed. Rep. of Germany . |
| 1241634 | 8/1971 | United Kingdom . |

*Primary Examiner*—Willis R. Wolfe
*Assistant Examiner*—M. Macy
*Attorney, Agent, or Firm*—Arthur N. Krein

[57] ABSTRACT

A direct acting hydraulic valve lifter of the type that is reciprocably journaled as in the cylinder head of an internal combustion engine so as to be engaged by a cam on an engine driven camshaft to control opening and closing movement of an associate valve. The lifter includes a follower body having a circular outer tubular wall with an inner integral web closely adjacent to one end thereof that terminates at a stepped bored integral depending piston, the one end thereof being closed by a disk cam engaging foot which forms with the piston and a surface of the web a fluid reservoir. A baffle, fixed to the plunger and to inner surface of the tubular wall, defines an oil supply passage which is adapted to receive fluid via a side port in the tubular wall and to be in flow communication with the fluid reservoir via an aperture in the web. A cup-shaped, closed end cylinder member slidably encircles the plunger to form therewith a hydraulic lash adjuster having a pressure chamber therein. In one enbodiment, a mechanical retainer is operatively secured to the tubular wall whereby to retain the cylinder member in unit assembly on the plunger. In a preferred embodiment, lubricating oil in the pressure chamber and in a leak-down flow path between the cylinder member and plunger and a one-way ball valve controlling flow into the pressure chamber are operative to hold the cylinder member in unit assembly on the plunger.

6 Claims, 4 Drawing Sheets

DIRECT ACTING HYDRAULIC VALVE LIFTER WITH INTEGRAL PLUNGER

FIELD OF THE INVENTION

This invention relates to hydraulic lifters or tappets used to maintain substantially zero lash in the valve train of an internal combustion engine and, in particular, to a direct acting hydraulic valve lifter of the type that is slidably journaled in a guide bore in the cylinder head of an engine directly between an overhead cam and the stem of a valve to be actuated thereby.

DESCRIPTION OF THE PRIOR ART

Direct acting hydraulic valve lifters, also referred to as bucket tappets, of the type that are directly acted upon by an overhead cam to control the opening and closing movement of an associate valve, either intake or exhaust, are well known in the art as disclosed, for example, in U.S. Pat. No. 3,509,858 entitled "Overhead Cam Valve Lifter" issued May 5, 1970 to Scheibe et al; U.S. Pat. No. 4,470,381 entitled "Hydraulic Tappet for Direct Acting Valve Gear" issued Sept. 11, 1984 to Buente et al; and, U.S. Pat. No. 4,578,094 entitled "Cup-Shaped Casing for a Hydraulic Tappet" issued Apr. 1, 1986 to Doppling et al.

Such direct acting hydraulic valve lifters normally include a bucket type follower body having a suitable external diameter outer cylindrical wall so as to be reciprocable in a guide bore provided for this purpose in the cylinder head of an engine at a location normally substantially concentric with the reciprocating axis of an associate valve. The follower body is substantially closed at its upper end by a cam engaging foot which can be formed integral with the outer cylindrical wall or formed as a separate part for attachment to the cylindrical wall as by brazing or welding, as well known in the art. The follower body is provided with a central bored hub defining a circular, axial extending bearing land or surface to slidably receive a hydraulic lash adjuster or lash compensating device of the type that includes a cup-shaped outer cylinder member or body slidable in the bearing land and having a plunger slidable therein relative to the body. The plunger is provided with a stepped bore whereby at its lower end it defines with the closed end of the outer cylinder member a pressure chamber that is supplied with pressurized hydraulic fluid, such as engine lubricating oil, as controlled by a one-way valve that is normally in the form of a ball valve.

SUMMARY OF THE INVENTION

The present invention relates to an improved direct acting hydraulic valve lifter that includes a bucket-type follower body having a tubular outer wall with an integral, internal transverse, apertured web and a central integral, hollow, plunger depending from the web. A cup-shaped outer cylinder member is slidably journaled on the outer peripheral surface of the plunger, the plunger and closed end of the outer cylinder member defining a pressure chamber adapted to be supplied with hydraulic fluid as controlled by a one-way valve. A ring like oil passage baffle is secured within the follower body so as to define a fluid supply passage or reservoir supplied with fluid via a side port in the follower body, the fluid supply reservoir chamber in turn being in flow communication via at least one passage in the transverse web with a fluid reservoir defined in part by the plunger.

It is therefore a primary object of this invention to provide an improved direct acting hydraulic valve lifter wherein the plunger of the hydraulic lash adjuster element is an integral part of the bucket-type follower body of the lifter.

Another object of the invention is to provide an improved direct acting hydraulic valve lifter of the so-called "bucket" type wherein the bucket type follower body has an integral transverse web which at substantially its center has a tubular plunger depending therefrom so as to define part of a hydraulic lash adjuster device.

Still another object of the invention is to provide an improved direct acting hydraulic valve lifter having a follower body with a web and depending plunger defining part of a hydraulic lash adjuster, an oil passage baffle means being fixed to the follower body so as to define therewith a fluid supply passage for supplying fluid to the hydraulic lash adjuster. In one embodiment, a retainer means is associated with the follower body to retain elements of the hydraulic lash adjuster in unit assembly within the follower body. The baffle means and retainer means can either be separate elements or a combined means.

For a better understanding of the invention as well as other objects and further features thereof, reference is had to the following detailed description of the invention to be read in connection with the accompanying drawing.

DESCRIPTION OF THE PREFERRED EMBODIMENTS

Figure 1:
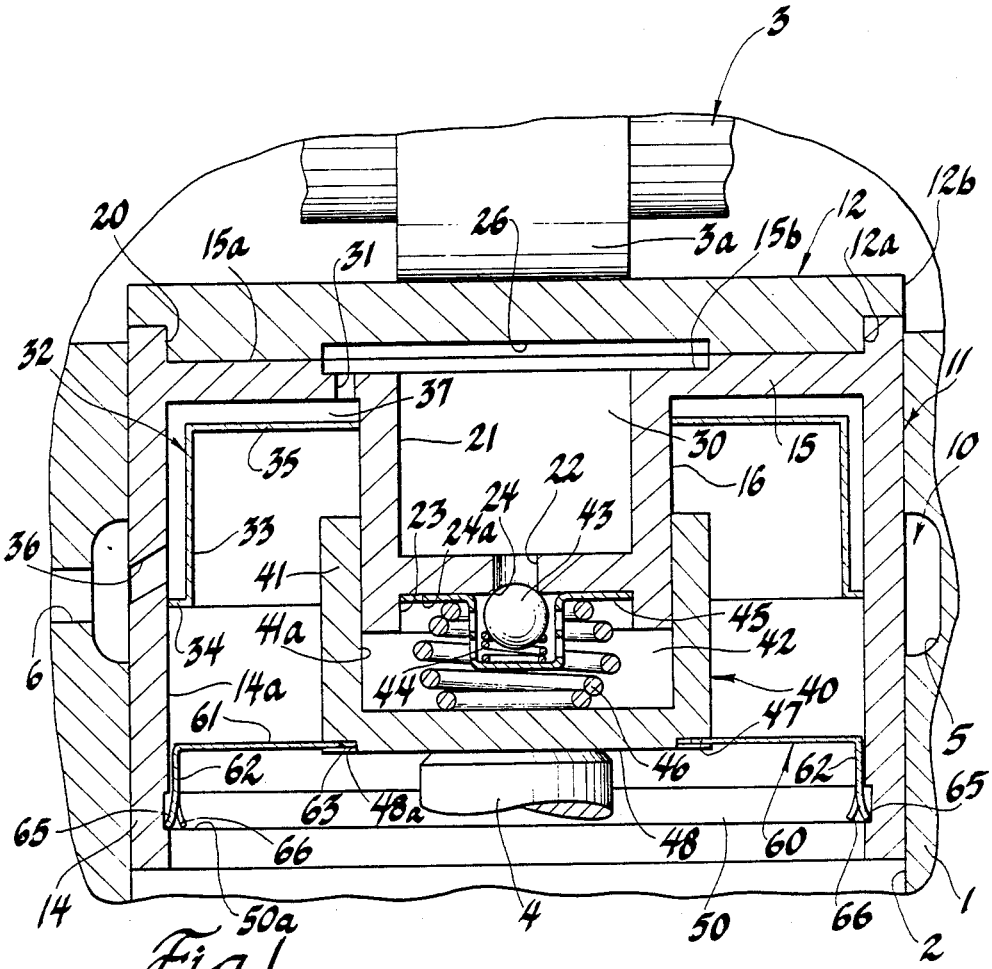
FIG. 1 is a vertical cross sectional view of a direct acting hydraulic valve lifter with integral plunger constructed in accordance with the invention.

Referring first to FIG. 1 there is illustrated a first embodiment of a direct acting hydraulic valve lifter which has, in the construction shown, a bucket type, follower, generally designated 10, that includes a tubular follower body, generally designated 11, and a foot 12 suitably secured to the follower body 11 so as to close the upper end thereof.

As illustrated in FIG. 1, the follower body 11 has a tubular outer wall 14 of a predetermined external diameter so as to be slidably received in a suitable guide bore 2 provided for this purpose in the cylinder head 1 of an engine, as well known in the art. Also, as well known in the art, the cylinder head 1 is preferably provided with a side window portion, not shown, adjacent to each guide bore 2 for access to the upper end of an associate valve 4. Formed integral with the outer wall 14 closely adjacent to the upper end thereof, with reference to FIG. 1, is a ring-like transverse web 15 that extends radially inward from the inner surface 14*a* of the outer wall 14 to interconnect with an integral, depending piston or plunger 16.

As shown, the follower body 11 including the web 15 and plunger 16 are counterbored so as to define in succession, starting from the top with reference to FIG. 1, a circular upper wall 20 of relatively large internal diameter corresponding substantially to the internal diameter of the inner surface 14*a* in the embodiment shown; concentric upper intermediate walls 21 and 21*a*; an intermediate wall 22 defining a plunger port; and a lower wall 23, the three walls 21, 22, and 23, in effect, being formed in the plunger 16 and with the part of wall 21*a* forming wall 21 being formed in the web 15. Walls 20 and 21 are connected by a flat shoulder or upper surface 15*a* of the web 15. Wall 22 is connected to wall 23 by a valve seat 24 encircling wall 22 and a flat shoulder 24*a*.

The upper end of the follower body 11 is closed by a foot 12, which in the construction shown, is suitably machined with a stepped outer peripheral surface with the reduced diameter portion 12*a* thereof being sized complementary to the wall 20 so as to be received thereby, while its upper enlarged outer peripheral surface 12*b* corresponds to the outside diameter of the tubular wall 14. As well known, at least the upper cam engaging surface 12*c* of the foot 12 is suitably hardened for engagement by the cam 3*a* of an engine driven camshaft 3. Also as well known, the follower body 11 and foot 12 can be made of the same or different materials depending on the specific engine application and can be configured at their joining interfaces, as desired, in a manner well known in the art. Also, as well known in the art, the foot 12 is preferably suitably secured to the follower body 11 as, for example, by brazing, diffusion bonding or welding.

In the construction shown in FIG. 1, the foot 12 is provided with a relatively shallow blind bore wall 26 on its lower side with reference to FIG. 1 so as to define an inner circular recessed cavity and the upper surface 15*a* of the web 15 is also provided with a similar recessed cavity formed by bore wall 27. The internal diameter of these cavities, as shown in FIG. 1 are substantially greater than that of upper intermediate walls 21 and 21*a* so as to extend radially outward thereof whereby to define with the walls 21 and 21*a* a fluid reservoir chamber 30 which is of T-shaped configuration when viewed in cross section as shown. It will be apparent to those skilled in the art that, if desired, either the recessed cavity in the foot 12 or the recessed cavity in the web 15 could be eliminated. This would of course, in effect, slightly reduce the volume of the top bar cross portion of the T-shaped reservoir chamber 30.

The reservoir chamber 30, in the construction shown in FIG. 1, is supplied with fluid via a vertical port 31 in the web 15, that is located radially outward of plunger 16, and which communicates at one end, in the embodiment shown in this Figure, with an annulus like fluid supply passage or reservoir 37 defined in part by the lower surface of the web 15 and a portion of the upper inner surface 14*a* and by a sheet metal, stamped oil passage baffle 32 suitably secured within the follower body 11 in spaced apart relationship relative to these surfaces. Thus in the embodiment shown in FIG. 1, the oil passage baffle 32 includes an annular upright wall portion 33, with an annular radial outward extending flange 34 at one or lower end thereof and with an annular radial inward extending flange 35 at its other or upper end. As will be appreciated by those skilled in the art, the elements of the baffle 32 can be formed as desired so as to increase the volume of the fluid supply passage or reservoir 37.

The external and internal diameters of the flanges 34 and 35, respectively, are selected so as to be secured as by a press fit to the inner and outer surface of the wall 14 and plunger 16, respectively. However, it will be appreciated by those skilled in the art that the baffle 32 can be secured as by welding, staking or other means known in the art so as to provide for a substantially fluid tight seal between mating parts.

Supply passage 37, in the embodiment shown in FIG. 1, is in communication via a through side port 36 in wall 11 whereby the supply passage 37 is supplied with engine oil as via an annular groove 5 in the wall of the guide bore 2 and an oil gallery 6 provided in the cylinder head 1 in a conventional manner. Also as well known in the art, it will be appreciated that alternatively, the side port 36 could communicate with an annular groove, not shown in FIG. 1 but shown in FIGS. 7 and 11, formed in the outer wall 14 surface of the follower body in a manner similar to that shown in the above-identified U.S. Pat. No. 3,509,858 and as otherwise well known in the art.

Referring now to the hydraulic lash adjuster device, it includes the integral plunger 16 and an outer, upper presenting, cup-shaped, cylinder member 40 slidably encircling the plunger 16. The outer peripheral surface of the plunger 16 and the inner peripheral surface 41*a* of the cylindrical wall 41 of the cylinder member 40 are suitably machined for a close sliding fit of these elements relative to each other while providing a predetermined diametrical clearance therebetween so as to define a leak-down flow path for the controlled "leak-down" flow of fluid from a fluid pressure chamber 42 defined by the closed end of the cylinder member 40 and the lower end of the plunger 16, as well known in the art and as clearly described in the above-identified U.S. Pat. No. 3,509,858.

One way flow of fluid from the fluid reservoir 30 to the pressure chamber 42, via the plunger port defined by wall 22, is controlled by a one way check valve, shown in the form of a ball 43, which is normally biased to a closed position against valve seat 24 by a valve return spring 44 or in response to fluid pressure in the pressure chamber 42. A check valve retainer or cage 45 and spring 44 limits opening travel of the ball 43 to the amount necessary to accommodate replenishment of the pressure chamber 42 with fluid as required. As shown, the check valve retainer or cage 45 is held in operative position against the surface 24*a* of the plunger 16 by a spring 46 which also acts against the closed end of the cylinder member 40 to normally bias it axially in a downward direction, with reference to FIG. 1, for abutment against the stem of an associate valve 4. Such downward movement of the cylinder member 40 is of a predetermined axial extent as controlled by, essentially, the as-formed height of the spring 46.

The hydraulic lash adjuster element assembly of the subject direct acting hydraulic valve lifter operates in the same well known manner as that of the overhead cam valve lifter described in the above-identified U.S. Pat. No. 3,509,858 except that in the subject lifter, the plunger 16 is fixed, that is, it is an integral part of the follower body 11.

It will be appreciated that with the plunger 16, which is made integral with the follower body 11, serves, with the outer cylinder member 40, the usual function of an outer cylinder member and piston or plunger assembly of prior art hydraulic lash adjusters and also serves as the only guide for axial movement of the outer cylinder member 40. Thus the machining of a separate guide gland and of the outer peripheral surface of the cylinder member, as previously required in the prior art direct acting hydraulic valve lifters of the type shown in the above-identified U.S. patent, is no longer required in the subject device.

As a feature of the subject invention, it has been found that if a hydraulic fluid, such as conventional engine lubrication oils or a test oil used for leak-down flow testing hydraulic lash adjusters, is supplied into the pressure chamber 42 and then the cylinder member 40 is reciprocated relative to the plunger 16 so as to force such fluid from the pressure chamber 42 into the above defined leak-down flow path, not numbered, then the spring 44 seated ball valve 43 and the fluid in the leak-down flow path will then act as seals against the ingress of atmospheric air into the pressure chamber whereby the ball valve 43 and the fluid in the leak-down flow path will be operative to, in effect, hold the cylinder member 40; ball valve 43; springs 44 and 46; and, valve retainer 45 in unit assembly onto the plunger 16 and thus with the follower body 10 for at least a suitable, relatively extended period of time.

This time period is sufficiently long so that if the subject direct acting hydraulic valve lifter is to be used as original equipment on new engines and the engine assembly plant is a plant of the type that operates with a first in time parts inventory program, then the subject lifter can be manufactured, assembled, tested, filled with hydraulic fluid as described above, shipped and then installed as a unit assembly in an engine in a time period that is less than the above referred to extended period of time. By way of an example, experience has shown that direct acting hydraulic valve lifters functionally similar in structure to that shown in the above-identified U.S. Pat. No. 3,509,858 and used as original equipment are installed in a new engine assembly within two days to a week from the date of shipment of such lifters from the lifter manufacturing plant to an engine plant. The above referred to relatively extended period of time far exceeds this two day to a week time frame.

However it may be desirable to provide, in addition to or in place of the above, a positive acting mechanical retaining means for holding the above-described elements of the subject direct acting hydraulic valve lifter in unit assembly. Such a mechanical retaining means would preferably be used if a subject lifter is built for use in the engine after market. In the after market, such a lifter may possibly be held in storage for indefinite, long periods of time and thus possibly subject to numerous changes in temperature and atmospheric pressure and may also be subjected to vibrations due to various shipments thereof and other factors, which if held in unit assembly as previously described may allow for the ingress of atmospheric air into the pressure chamber 42 whereby to allow the cylinder member 40 to become dis-assembled from the plunger.

Accordingly, a number of different types of mechanical retainer means will be described hereinafter, with some embodiments of these retainer means being constructed so that, if desired, they can be retained as part of the direct acting hydraulic valve lifter assembly as installed in an engine, while other embodiments are constructed so that these latter retainer means are removed prior to or after the associate direct acting hydraulic valve lifter is operatively installed in an engine as described in detail hereinafter.

For this above-described purpose and a purpose to be described and, as shown in the embodiment of FIG. 1, the cylinder member 40 at its lower outer peripheral edge is grooved so as to define an annular abutment shoulder 47 adjacent to the lower valve 4 engaging closed end surface 48 of the cylinder member 40 and connected thereto by the outer peripheral wall 48*a*. In addition in the construction shown in FIG. 1, the inner peripheral surface 14*a*, next adjacent to the lower end of the outer wall 14 is provided with an annular groove 50 so as to define an annular lower shoulder 50*a* opposed to abutment shoulder 47.

In this FIG. 1 embodiment, a retainer means in the form of a retainer 60, made of a suitable plastic or metal material, and of a suitable configuration, is operatively associated with the lower shoulder 50*a* in the outer wall 14 of the follower body 11 whereby it can serve as an abutment means for engagement by the annular abutment shoulder 47 so as to limit downward travel of the cylinder member 40, as desired to thus maintain the cylinder member 40 and the associate ball 43, springs 44 and 46, and cage 45 of the hydraulic lash adjuster elements in unit assembly with its plunger 16 and thus with the follower body 11.

Figure 2:
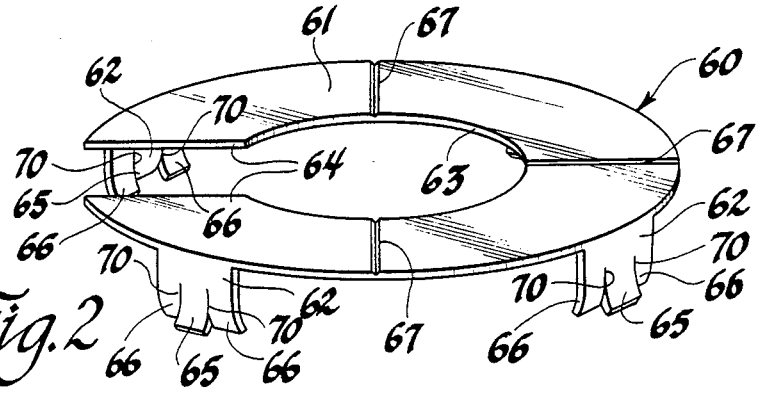
FIG. 2 is a perspective view of a preferred embodiment of the retainer, per se, of the valve lifter of FIG. 1.

In a preferred embodiment as shown and as best seen in FIG. 2, the retainer 60 is made of a molded plastic material suitable for the intended environment and the retainer 60 includes a split, semi-annular disk base 61 with a plurality of circumferentially spaced apart spring arm members 62 integral with and depending from the outer peripheral edge of the base 61 with a terminal end portion of each spring arm member 62 being adapted to have locking engagement against the lower shoulder 50*a* in the wall 14, only two such spring arm members 62 being shown in FIG. 1 as if diametrically spaced apart. As shown, the base 61 is provided with a central aperture having an internal diameter at its inner peripheral edge 63 greater than the outside diameter of peripheral wall 48*a* but less than that of the major external diameter of the cylinder member 40, the latter being best seen in FIG. 1.

In addition with this preferred embodiment, if after insertion of a subject direct acting hydraulic valve lifter into an engine as shown in FIG. 1, it is found desirable to remove the retainer 60 so as to reduce the overall mass of such a lifter, the retainer 60, as shown in FIG. 2, can be provided with a radial through slot, the side edges 64 of which are spaced apart a distance greater than the outside diameter of the free stem end of the valve 4 so as to facilitate the removal of the retainer 60 from around the valve 4.

In addition for the above purpose and in the preferred embodiment shown in FIGS. 1 and 2, each of the spring arm members 62 are pierced at their respective lower ends as at 70, so as to define a central spring finger 65 bent radially inward a suitable distance so that its lower end can be flexed radially inwardly by the inner surface 14*a* of the outer wall 14 during insertion of the retainer 60 into the follower body 11 and then flex outwardly into the annular groove 50 whereby the free end or abutment shoulder 65*a* of the respective spring fingers 65 can abut against the annular lower shoulder 50*a*. On opposite sides of an associate spring finger 65 there is provided a pair of fingers 66, each of which is bent radially inwardly a suitable distance whereby these fingers 66 can be engaged by a suitable tool, such as a screwdriver, to allow the spring arm member 62 to be flexed radially inwardly so that the associate spring finger 65 can be released from its engagement from the shoulder 50.

Also as shown in FIG. 2, if in the preferred embodiment the retainer 60 is made of a suitable plastic material, the base 61 can be provided with circumferentially spaced apart shallow radial grooves 67 defining fracture lines, as well known in the plastic art, whereby the base 61 can be easily fractured into somewhat pie-shaped segments for easier removal from the follower body 11. In the construction shown in FIG. 2, three such radial grooves 67 are provided and suitably angularly located so as to permit removal of the retainer 60 in four separate segments.

Figure 3:
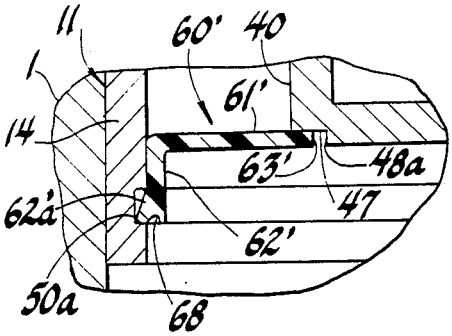
FIG. 3 is a vertical cross sectional view of a lower portion of the follower body and cylinder member, per se, of FIG. 1, with a retainer in accordance with a first alternate embodiment associated therewith.
Figure 4:
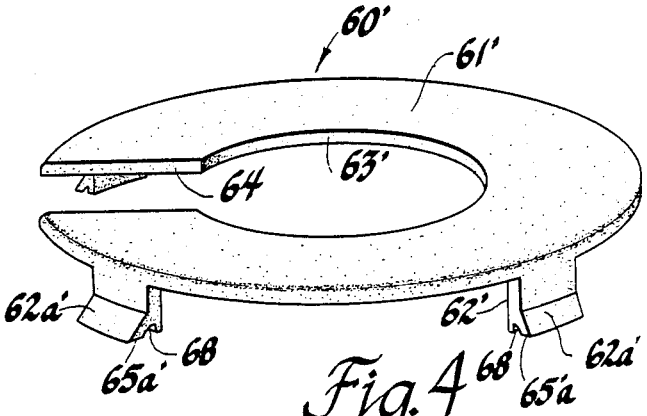
FIG. 4 is a perspective view of the first alternate embodiment retainer, per se, of FIG. 3.

A first alternate embodiment of a retainer means or retainer, generally designated 60', in accordance with a feature of the invention for use with the lifter illustrated in FIG. 1, is shown in FIGS. 3 and 4, wherein similar parts are designated by similar numerals but with the addition of a prime (') where appropriate.

The retainer 60', in this first alternate embodiment shown in FIGS. 3 and 4, made of a suitable molded plastic material, is formed with a split ring base 61' and with a plurality of circumferentially spaced apart depending spring arm members 62'. Each spring arm member 62' is provided on its outer peripheral lower free end with an inclined, radially outward extending cam portion 62*a'* so as to define, in effect, an abutment shoulder 65*a'* for abutment against the lower shoulder 50*a* of the groove 50 in the wall 14 of the follower body 11.

With this arrangement, during insertion of the retainer 60' into the follower body 11, the cam portion 62*a'* on each of the spring arm members 62' will cause the respective members 62' to flex radially inwardly until such time as the spring arm members 62' can again flex radially outwardly to a position whereby each of the abutment shoulders 65*a* enter the groove 50 for abutment against the annular wall 50*a* defining the lower end of the groove 50 in the wall 14 of the follwer body 11.

In addition, each of the spring arm members 62' at its lower free end is preferably provided with a notch or groove 68 so that, for example, the tip of a suitable tool, not shown, can be inserted therein, whereby the respective spring arm members 62' can be moved radially inwardly so as to effect release of the spring arm members 62' out of the groove 50 whereby the retainer 60' can be removed from the follower body 11, if desired.

As in the previously described retainer 60, the base 61' of retainer 60' is also provided with a central aperture having an edge 63' and a slot defined by the side edges 64'.

Figure 5:
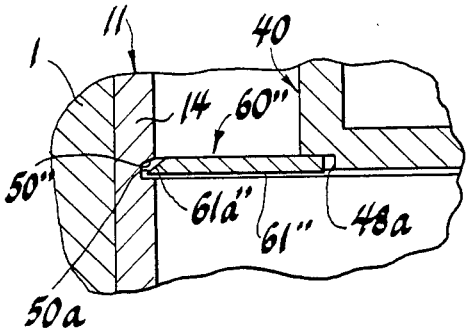
FIG. 5 is a vertical cross sectional view similar to FIG. 3 but with a second alternate embodiment retainer associated therewith.
Figure 6:
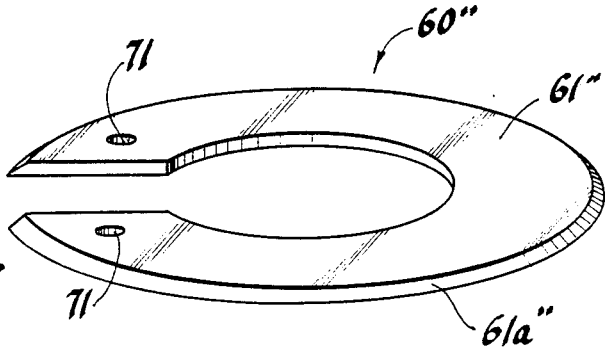
FIG. 6 is a perspective view of the second alternate embodiment retainer, per se, of FIG. 5.

A second alternate embodiment of a retainer means or retainer, generally designated 60'', in accordance with a feature of the invention is shown in FIGS. 5 and 6 wherein similar parts are designated by similar numerals but with the addition of a double prime (") where appropriate.

In this second alternate retainer embodiment, the retainer 60'' is in the form of a split ring retainer of metal or plastic material, the retainer 60'' having a split ring base 61'' with the outer edge thereof being inclined as at 61*a''*. As in regular split ring retainers, the split ring base 61'' is slotted with the free end edges 64'' thereof being spaced apart a predetermined distance. Adjacent to these side edges 64'', the base 61'' is provided with through apertures 71 to permit assembly or dis-assembly of the retainer 60'' from the follower body 11 by means of a pair of conventional type snap or split ring pliers, not shown.

As shown in FIG. 5, if the split-ring retainer 60'' is used to retain the cylinder body 40 and associate elements in unit assembly with the follower body 11, the groove 50'' in the wall 14 is located a predetermined distance above the bottom edge of the wall 14 so as to limit downward travel of the cylinder member 40, as desired, in a particular lifter structure.

It will now be apparent that the retainer 60'', as formed will have a nominal external diameter that is a predetermined amount greater than the internal diameter of the wall 14 surface 14*a* but less than the maximum internal diameter of the groove 50''. The assembly of the retainer 60'' into the groove 50'' in the follower body 11 is accomplished by means of a pair of snap ring pliers, not shown, used to reduce the effective external diameter by movement of the free ends of this retainer 60'' together to thus permit its insertion into the follower body 11 to a position adjacent the groove 50'', after which the retainer 60'' is again allowed to expand to its normal external diameter, whereby its lower outer peripheral edge surface can abut against the shoulder 50*a''*. For purpose of illustration, the retainer 60'' is shown as positioned during installation thereof and is thus located above the shoulder 50*a''*.

It will be apparent that the retainer 60'' instead of being formed as a single element as described and illustrated could be formed as two separate elements so as to include a centrally apertured disk, of an external diameter a predetermined amount less than the internal diameter of wall 14, and a conventional, commercially available type snap or split ring retainer, both not shown, with the latter being used to define a shoulder for supporting the centrally apertured disk.

Figure 7:
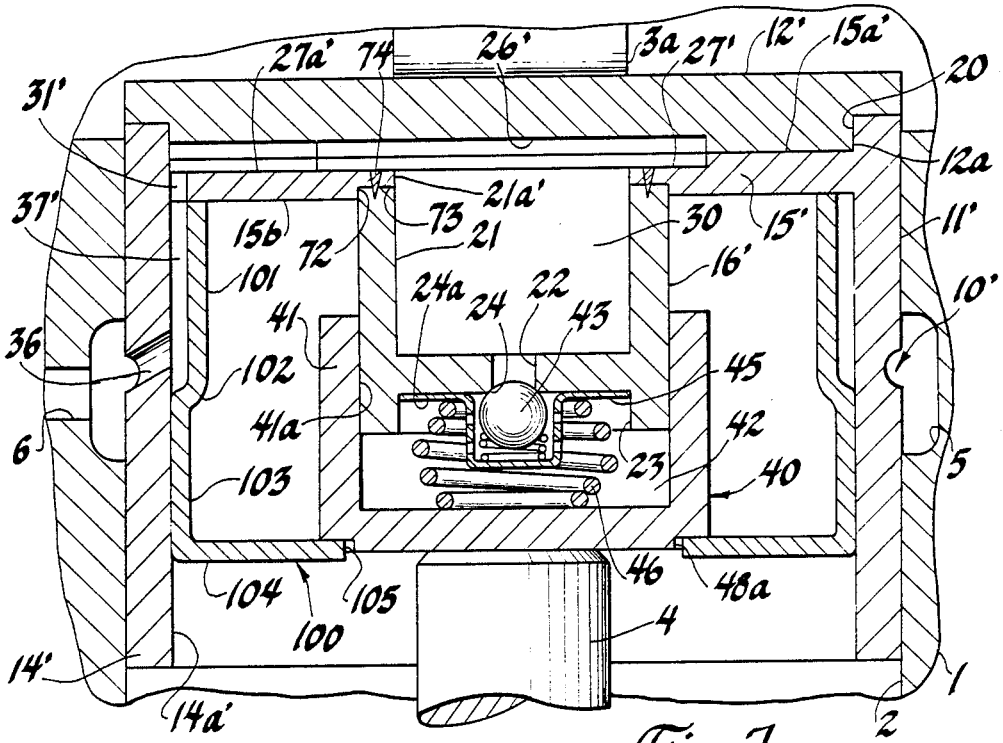
FIG. 7 is a vertical cross sectional view of a direct acting hydraulic valve lifter with integral plunger constructed in accordance with an alternative embodiment of the invention and having a combined baffle/retainer structure therein.

A first alternate embodiment of a direct acting hydraulic valve lifter, generally designated 10'', is shown in FIG. 7, wherein similar parts are designated by similar numerals but with the addition of a prime (') where appropriate.

In this alternate embodiment, the plunger 16' is formed as a separate element, which, after having, at least, its outer peripheral surface machine finished, is suitably secured, as preferably by an electron beam or a laser beam welding process, to the web 15' of the follower body 11'.

Accordingly, for this purpose and in the construction shown in FIG. 7, the web 15', formed integral with the outer wall 14' of the follower body 11', as described in the FIG. 1 embodiment, is provided with a central stepped through bore which defines starting in succession from its lower surface **15*b'* a circular lower wall 72 and an upper wall 21*a'* interconnected by a flat shoulder 73. As shown, the lower wall 72 is sized so as to receive the upper end, with reference to FIG. 7, of the plunger 16' while the upper wall 21*a'* is formed complementary to the size of the wall 21' of the plunger 16'** so as to form an extension thereof.

Thus after finish machining of the plunger 16' it can be inserted into the lower wall 72 of the web 15' with its upper end surface in abutment against the flat shoulder 73 and then the plunger 16' is fixed integral with the web 15' of the follower body 11' preferably by an electron beam or a laser beam welding process, as shown at 74. These two welding processes are preferred since in either process the heat affect zone is very narrow and thus will not affect the exposed finished, exterior, operating surface of the plunger 16'.

Thus in view of the above, from at least the ease in which the plunger 16' can be machine finished, the FIG. 7 embodiment can be considered as the preferred embodiment.

In addition, in the embodiment of the direct acting hydraulic valve lifter 10' illustrated in FIG. 7, the function of the oil passage baffle and that of the retainer means for this lifter 10' are combined into a one-piece oil passage baffle/retainer member, generally designated 100, which can be made of a suitable metal or plastic material.

The oil passage baffle/retainer member 100, in the construction shown in FIG. 7, is formed of sheet metal and includes an annular, upright, upper wall 101 which at its lower end is connected by an annular inclined wall 102 to an annular upright lower wall 103. As shown, the lower end of the wall 103 is in turn integrally connected to a centrally apertured retainer disk 104.

As illustrated in FIG. 7, the upper wall 101 is of a predetermined external diameter less than the internal diameter of the wall surface **14*a'* of the wall 14 of follower body 11' and is of an axial extent such that with the upper edge surface of the wall 101 in abutment against the lower surface 15*c* of the web 15' there is defined an annulus shaped fluid supply passage or reservoir 37' which is in fluid communication with the side port 36 in the follower body 11'. In this embodiment, an annular supply groove 36*a* is provided in the outer peripheral surface of wall 14 and located to be in flow communication with the outboard end of side port 36**.

The external diameter of the lower wall 103 of the oil passage baffle/retainer member 101 is sized complementary with the internal diameter of the inner surface **14*a'* of the wall 14' of the follower body 11'**.

The oil passage baffle/retainer member 100 can be fixed in the follower body 11' in the position shown in FIG. 7 as by being press-fitted therein, by staking or by the use of spring tabs, not shown, which could be similar to those used in the retainer 60 shown in FIGS. 1 and 2. In addition, if the oil passage baffle/retainer member 100, is of a suitable metal material, it can be fixed in and to the follower body 11' by an electron beam or laser beam welding process. For example, the web 15' and upper end surface of the upper wall 101 interface can be fixed together by an annular weld 74, the lower end interface of the lower wall 103 and inner surface **14*a* of the wall 14 can be fixed together by an annular weld, not shown, or both welds can be used to secure such an oil passage baffle/retainer member 100 to the follower body 11'** in fluid tight relationship to each other.

In the embodiment shown in FIG. 7, a key-hole shaped recessed cavity is formed in the upper surface **15*a'* of the web 15' so as to define a semi-circular wall 27' encircling walls 21*a'* and 21 in the web 15' and plunger 16', respectively, and a radial slot wall 27*a'* located so as to be in flow communication with a port 31', that extends through the web 15' next adjacent to the internal surface 14*a'* of the outer wall 14', so as to be in flow communication with the reservoir 30. In the construction shown, a similar and aligned key-hole cavity defined by walls 26' and 26*a'* is provided in the foot 12'**.

As should now be apparent, the aperture defined by the edge wall 105 in the apertured disk 104 is suitably sized whereby this apertured disk 104 will act as a retainer for the cylinder member 40 so as to hold it in unit assembly with the plunger 16'.

Figure 8:
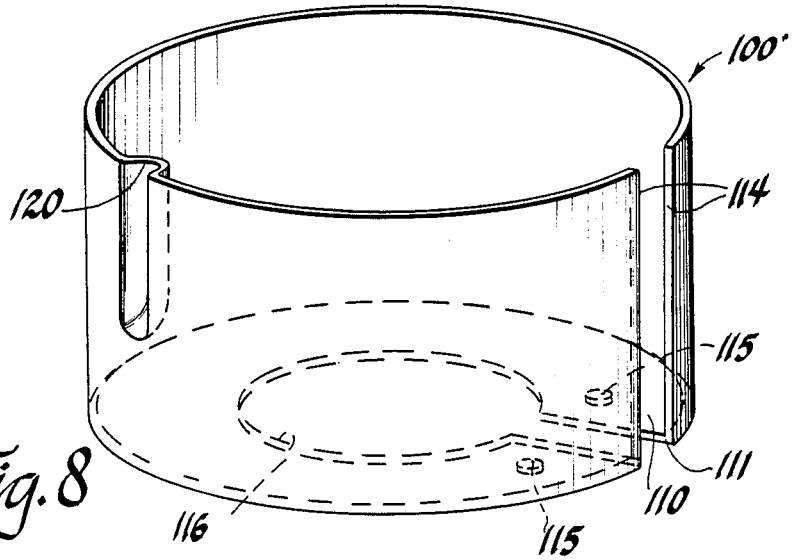
FIG. 8 is a perspective view of an alternate embodiment combined baffle/retainer structure, per se.

An alternate embodiment of an oil passage baffle/-retainer member, generally designated 100', is shown in FIG. 8.

In this alternate embodiment, the oil passage baffle/-retainer member 100', made of a suitable metal, is of a split ring, open, cup-shaped configuration and it includes a split ring retainer base 110 with a semi-circular wall 111 upstanding from its outer peripheral edge. The free end edges 114 of the retainer base 110 and wall 111 are spaced apart a predetermined distance. The retainer base 110 adjacent to the end edges 114 is provided with through apertures 115 so as to receive a conventional type split ring pliers, not shown.

The nominal internal diameter of the aperture edge 116 in the retainer base 110 is greater than the outside diameter of wall **48*a* of an associate cylinder member 40 but less than the outside diameter of the cylinder member 40 and, the nominal, as formed, outside diameter of the wall 111 is sized complementary to the internal diameter of the inner surface 14*a'* of the wall 14 of an associate follower body 11'**.

The arrangement is such that by the use of a pair of split ring pliers, not shown, the end edges 114 can be forcibly moved together sufficiently so as to reduce the effective outside diameter of the retainer base 110 and wall 111 whereby this oil passage baffle/retainer member 100' can telescopically be received by the internal surface **14*a'* of the wall 14' of the follower body 11', with reference to FIG. 7, such that the upper end surface of the wall 111 will abut against the bottom surface 15*b'* of the web 15' in the follower body 11'. After release of the force on the pair of split ring pliers, not shown, the retainer base 110 and wall 111 can expand toward its nominal exterior or outside diameter whereby the outer peripheral surface of the wall 111 substantially sealingly engages the inner surface 14*a* of the follower body 11'** as if it had been inserted therein as by a press fit.

In addition, the wall 111 is deformed radially inwardly so as to define a grooved portion or channel 120 of a suitable axial extent such that when the member 100' is inserted into a follower body 11', as described above, and properly angularly oriented the grooved portion or channel 120 will form with an associate portion of the inner surface **14*a* of the follower body 11' a fluid reservoir, not shown, which would communicate at one end with side port 36 and at its other end with the port 31', with reference to the FIG. 7 follower body 11'** embodiment.

Figure 9:
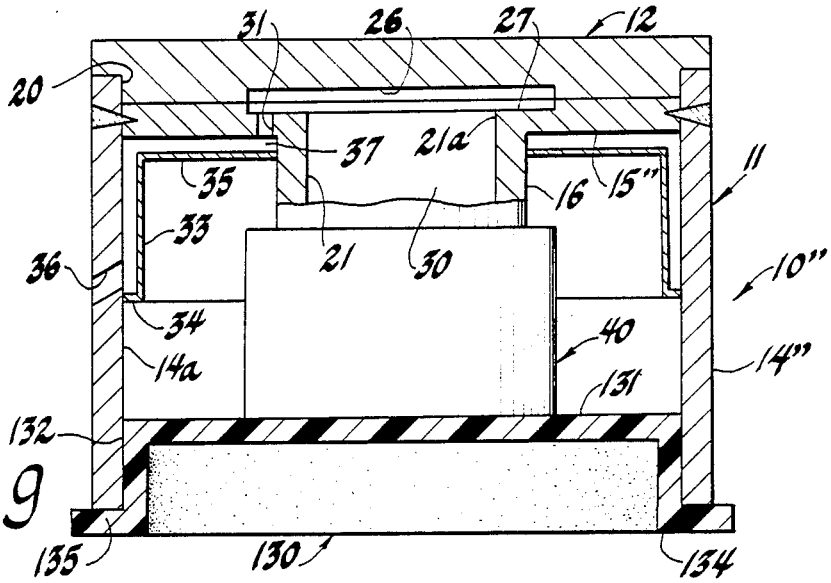
FIG. 9 is a vertical cross sectional view of a direct acting hydraulic valve lifter with integral plunger constructed in accordance with an alternate embodiment of the invention and having a removable plug type retainer associated therewith.

A second alternate embodiment of a direct acting hydraulic valve lifter, generally designated 10'' is shown in FIG. 9, wherein similar parts are designated by similar numerals but with the addition of a double prime (") where appropriate.

In this second alternate embodiment, the annular wall 14'' is formed as a separate element, which, after having at least, its inner peripheral surface **14*a*, with or without groove 50 therein, and the rim edge of web 15'' machine finished, has the rim edge of web 15''** suitably secured thereto, as preferably by electron beam or laser beam welding as disclosed, for example, in German patent application publication No. 27 58 957 published July 5, 1979.

Except for the above, this second embodiment direct acting hydraulic valve lifter 10'' may, as illustrated, be structurally and functionally the same as the lifter 10 shown in FIG. 1.

A third alternate embodiment of a retainer means or retainer, generally designated 130, is also shown in FIG. 9. This retainer 130, which is similar to a closure plug of the type conventionally used with tubular conduits, such as pipes, includes a hollow, inverted cup shaped plug member having a base 131 against which the cylinder member 40 can abut, with an annular wall 132 depending therefrom. The outer diameter of wall 132 is preselected relative to the internal diameter of wall 14 of the follower body 11 whereby it can be releasably secured therein as by a press fit so as to hold the cylinder member 40 and associate elements in unit assembly with the plunger 16 of follower body 11.

The wall 132, at its lower end, is connected to a radially outwardly extending annular flange 134 sized so as to abut against the lower end surface of wall 14. Preferably as shown, one or more pull tabs 135 extend radially outward from the flange 134 so as to permit an assembler or mechanic to grip a tab 135, as by a pair of pliers, not shown, to effect removal of the retainer from the follower body 11.

Since a direct acting hydraulic valve lifter, in accordance with the invention is normally shipped in a square shaped box sized to snug-like receive the outer peripheral surface of the wall 14 of the follower body 10'' with, for example reference to FIG. 9, the flange 134 and plural pull tabs 135 are arranged so as to define a square, sized to fit in such a square shaped box. Accordingly, in such an arrangement, there would be four pull tabs 135 with the sides of each adjacent pair of these pull tabs 135 merging tangentially with the flange 134. Thus the views in FIGS. 9 and 10 are along a line intersecting the opposed corners of the retainers shown.

Figure 10:
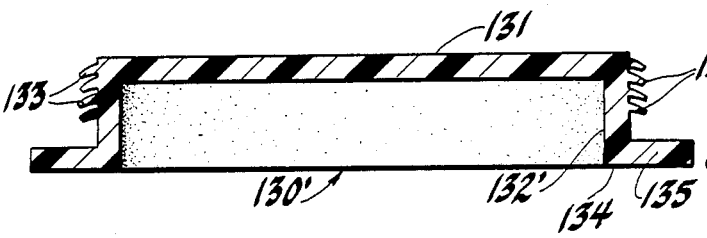
FIG. 10 is a vertical cross sectional view of a first alternate embodiment of a removable plug type retainer, per se; and, FIG. 11 is a cross sectional view of the direct acting hydraulic valve lifter of FIG. 9 but having a removable cap type retainer associated therewith.

A fourth alternate embodiment of a retainer means or retainer, generally designated 130', is shown in FIG. 10, wherein similar parts are designated with similar reference numerals but with the addition of a prime (') where appropriate.

This retainer 130' is also in the form of a closure plug and is thus similar to the retainer of FIG. 9, except that its annular wall 132' is provided with a series of either circumferentially spaced apart or preferably annular, vertically spaced apart saw-like teeth 133, the nominal outside diameter of these teeth 133 being sized so that they will flex upon insertion of the retainer into the wall 14 of a follower body 10'' with reference to FIG. 9 but then tend to frictionally grip the wall surface **14*a* so as to effect releasably retention of the retainer to the follower body 10''**.

In the construction shown, the flange 134 and pull tabs 135 are the same as those of the retainer 130 of FIG. 9 as described hereinabove.

Figure 11:
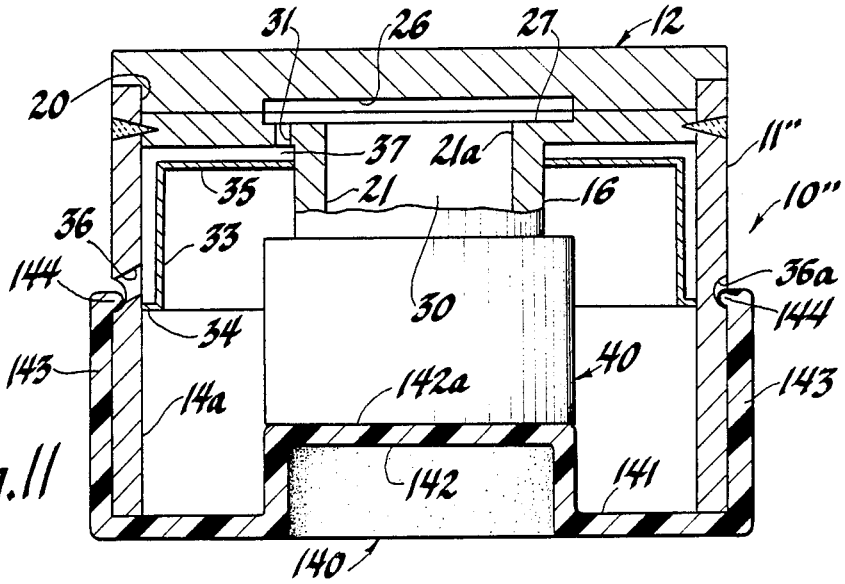

Referring now to FIG. 11, there is illustrated a fifth alternate embodiment of a retainer means or retainer, generally designated 140.

Retainer 140, which is somewhat similar to a closure cap of the type also used, for example, on tubular conduits, such as pipes, includes a disk-like base 141 with a hollow, annular boss 142 upstanding substantially centrally thereof. As shown, the height of the boss 142 is preselected whereby its upper surface **142*a* is positioned to serve as an abutment and thus as a retainer for the cylinder member 40 as shown in FIG. 11**.

Base 141 of this retainer 140 is provided at its outer peripheral edge with preferably a plurality of circumferentially spaced apart upstanding, arcuate shaped, when viewed in cross section, not shown, flexible spring legs 143, each of which terminates at its free end in a radially inward extending tooth 144. As shown, the nominal internal diameter, the axial extent of the spring lets 143 and the associate teeth 144 is preselected so that when the retainer 140 is assembled to a follower body 11, the position shown in FIG. 11, the associate tooth 144 of each spring leg 143 will be frictionally engaged in the annular groove **36*a* of the follower body 11'' so that this retainer 140 will releasably hold the cylinder body 40 and associate elements in unit assembly on the plunger 16 and thus with follower body 11**.

Since none of the retainers 130, 130' or 140 are provided with a central aperture as provided, for example, in retainer 60, it will be apparent to those skilled in the art that each such retainer 130, 130' and 140 must be removed from an associate, subject direct acting hydraulic valve lifter 10, 10'' before the lifter can be assembled into the cylinder head 1 of an engine.

Accordingly, an assembler or mechanic would, before installing the lifter must first remove the retainer 130, 130' or 140 from the follower body 11, 11' of the lifter 10, 10'', respectively. To do this, the lifter 10, 10'' is first inverted relative to its normal working position, the position as shown for example, in FIG. 1 and then the retainer 130, 130' or 140 is removed. However, before assembly into an engine the assembler or mechanic should then first repeatedly pump the cylinder member 40 relative to an associate plunger 16, 16' so that if lubricating oil is present in the pressure chamber 42, some of this oil will flow into the leak-down flow path to insure unit assembly of these and associate elements as described hereinabove. An attempt should then be made to axially move the cylinder member 40 from the plunger 16, 16''. If this cannot be done, this is an indication that the lubricating oil in the leak-down flow path and the ball valve 24 are then operative to hold the cylinder member 40 and associate elements on the plunger 16, 16' and, accordingly that lifter assembly is ready for installation into the cylinder head 1 of an engine.

On the other hand, if the cylinder member 40 can be removed from the plunger 16, 16', it and associate elements should then be removed from the associate follower body so that a small quantity of lubricating oil can be placed into the cylinder member 40 while it is standing upright. After this the cylinder member 40, and associate elements, are again assembled onto the plunger 16, 16' as illustrated in FIGS. 1, 7, 9 and 11.

After this assembly sequence, the cylinder member 40 should then be repeatedly pumped relative to the associate plunger 16, 16' so as to force lubricating oil into the leak-down flow path to thus effectively seal this flow path to prevent ingress of air into the associate pressure chamber 42. Upon completion of this pumping action, the cylinder member 40 can then again be axially pulled on to determined if it and associate elements are then being held in unit assembly with the plunger 16, 16' in the manner and for the reasons described hereinabove. Assuming that such is the case, the direct acting hydraulic valve lifter is then ready for installation in the cylinder head 1 of an engine.

If on the other hand, the cylinder member 40 is still not being held in unit assembly with the plunger 16, the above described steps should be repeated until such time as the cylinder member 40 and associate elements are held in unit assembly on the plunger 16, 16' by the sealing effect of lubricating oil in the leak-down flow path and operation of the ball valve 24, as previously described.

The term "integral" as used herein, and thus applicable only to the subject invention, refers to parts or elements of the follower body that are suitably formed or united together whereby the follower body includes all essential parts or elements thereof necessary for its intended function as described hereinabove.

While the invention has been described with reference to the structures disclosed herein, it is not confined to the specific details set forth, since it is apparent that many modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. A direct acting hydraulic valve lifter which is adapted to be reciprocably guided in a guide bore in the cylinder head of an engine and which is adapted to be engaged at one end by a cam on an engine driven camshaft and to engage a valve at its opposite end, said direct acting hydraulic valve lifter including a follower body having a tubular outer wall with a first end and a second end and defining an outer peripheral surface for sliding engagement in said guide bore, said follower body further including a web portion extending radially inwardly from said outer wall adjacent to said first end thereof, said web portion having a central aperture therethrough and a tubular plunger with a stepped bore therethrough depending integrally from said web portion concentric with said central aperture and extending axially toward said second end;

a foot member fixed to said first end of said outer wall with one side thereof defining a cam engaging surface and the opposite side thereof with said web defining means which with a portion of said central aperture and said stepped bore in said plunger define a fluid reservoir;

an oil passage baffle means operatively associated with the interior surface of said tubular wall so as to define a fluid passage;

an aperture in said web connecting said fluid passage to said fluid reservoir;

a side port in said annular wall in flow communication at one end with said fluid passage, the opposite end being adapted for flow communication with a source of pressurized engine lubricating oil;

a cup-shaped cylinder member with a closed end slidably journaled on said plunger, said closed end of said cylinder member and the lower free end of said plunger defining a pressure chamber; and, a one-way valve controlled passage means in said plunger controlling flow communication between said fluid reservoir and said pressure chamber.

2. A direct acting hydraulic valve lifter according to claim 1 wherein the internal peripheral surface of such cylinder member and the external peripheral surface of said plunger having a predetermined diametrical clearance whereby to define an annulus shaped leak-down flow path therebetween, and, lubricating oil in at least said pressure chamber and in said leak-down flow path so as to be operative so as to effect unit assembly retention of said cylinder member on said plunger.

3. A direct acting hydraulic valve lifter according to either claim 1 or claim 2, further including a retainer means operatively associated with said follower body so as to be operative whereby to retain said cylinder member in unit assembly with said plunger.

4. A direct acting hydraulic valve lifter according to claim 3 wherein said retainer means has a central aperture therethrough whereby said cylinder member can engage the valve extending through said aperture.

5. A direct acting hydraulic valve lifter according to claim 4 wherein said centrally apertured retainer means is an integral part of said oil passage baffle means.

6. A direct acting hydraulic valve lifter which is adapted to be reciprocably guided in a guide bore in the cylinder head of an engine and which is adapted to be engaged at one end by a cam on an engine driven camshaft and to engage a valve at its opposite end, said direct acting hydraulic valve lifter including a follower body having a tubular outer wall with a first end and a second end and with the outer peripheral surface thereof being adapted for sliding engagement in the guide bore, said follower body further defining a web portion with a central aperture therethrough extending radially inwardly from said outer wall adjacent to said first end thereof and a tubular plunger with a stepped bore therethrough depending integrally axially from said web portion toward said second end and located so as to encircle said central aperture;

said follower body at said first end including structure defining a cam engaging surface; said structure with said web defining means which, with a portion of said stepped bore in said plunger and said central aperture define a fluid reservoir;

an oil passage baffle means operatively associated with the interior surface of said tubular wall in spaced apart relationship to said web and fluid passage;

an aperture in said web connecting said fluid passage to said fluid reservoir;

a side port in said annular wall in flow communication at one end with said fluid passage and at its opposite end in flow communication with a source of pressurized engine lubricating oil;

a cup-shaped cylinder member with a closed end slidably journaled in said plunger, said closed end of said cylinder member and the lower free end of said plunger defining a pressure chamber;

a one-way controlled passage means defined in part by said stepped bore in said plunger controlling flow communication between said fluid reservoir and said pressure chamber; and a centrally apertured retainer means operable to retain said cylinder member in operative assembly with said plunger.

* * * * *